United States Patent [19]

Nishioka et al.

[11] Patent Number: 4,851,052

[45] Date of Patent: Jul. 25, 1989

[54] METHOD OF PRODUCING STEEL PLATE WITH GOOD LOW-TEMPERATURE TOUGHNESS

[75] Inventors: Koyoshi Nishioka; Hiroshi Tamehiro; Masahiko Murata, all of Kimitsu, Japan

[73] Assignee: Nippon Steel Corpopration, Tokyo, Japan

[21] Appl. No.: 186,077

[22] Filed: Apr. 25, 1988

[30] Foreign Application Priority Data

Apr. 24, 1988 [JP] Japan ..... 62-99685

[51] Int. Cl.[4] ..... C21D 8/02

[52] U.S. Cl. ..... 148/2; 148/3; 148/12 F; 164/476; 164/477

[58] Field of Search ..... 148/2, 3, 12 F, 134, 148/320; 164/476, 477

[56] References Cited

U.S. PATENT DOCUMENTS 3,990,887 11/1976 Hisada ..... 148/320

FOREIGN PATENT DOCUMENTS 61-119652 6/1986 Japan ..... 148/2

61-157628 7/1986 Japan ..... 148/2

*Primary Examiner*—Deborah Yee

*Attorney, Agent, or Firm*—Wenderoth, Lind & Ponack

[57] ABSTRACT

A method of producing steel plate with good low-temperature toughness comprises the steps of casting a steel melt consisting of 0.001–0.300 wt % C, not more than 0.8 wt % Si, 0.4–2.0 wt % Mn, not more than 0.007 wt % Al, 0.0010–0.0100 wt % O and the remainder of iron and unavoidable, impurities, and subjecting the cast steel either as it is or after rolling at a small reduction ration to accelerated cooling. In the cooling step, a fine-grained acicular ferrite texture having oxide-system inclusions as the nuclei develops radially and provides the resulting steel plate with excellent low-temperature toughness.

5 Claims, No Drawings

METHOD OF PRODUCING STEEL PLATE WITH GOOD LOW-TEMPERATURE TOUGHNESS

BACKGROUND OF THE INVENTION

1. Field of the Invention

This invention relates to a method of producing tough steel plate that is homogeneous and nonoriented and more particularly to a method for producing such steel plate without reheating following casting, wherein the desired steel plate is obtained simply by casting or by rolling at a low reduction ratio after casting.

2. Description of the Prior Art

In the production of steel plate by hot rolling there has in recent years been a strong movement toward the realization of cost reduction through the simplification and elimination of production steps. The hot charge rolling method in which the intermediate step of reheating between casting and hot rolling is eliminated is one example of this trend.

However, most of the hot charge rolling processes developed to date rely on an ensuing rolling step for the production of fine crystal grains and have not been able to realize the elimination or simplification of the rolling step.

In this specification, the term "hot charge rolling" will be used to mean a process in which a slab is subjected to hot rolling following casting or continuous casting.

While it is well known to be metallurgically feasible to conduct hot charge rolling of steel plate with respect to mild and ordinary steels for which the low-temperature toughness requirements are not so stringent, application of the hot charge rolling process to, for example, low-temperature steels and high-tensile steels requiring low-temperature toughness results in products with low-temperature toughness that is inferior to those obtained by conventional production processes.

The main reason for this is that in the hot charge rolling process the initial austenite grains present prior to rolling are extremely large, making it difficult to realize a fine-grained texture through rolling. As a way of avoiding this problem it has been proposed to conduct strong controlled rolling prior to controlled cooling. (See, for example, Japanese Published Unexamined Patent Application No. 57(1982)-131,320.) However, the use of this method introduces an additional requirement for time-temperature control and thus greatly impairs the productivity of the rolling process.

For overcoming the limitation on the fineness of the texture obtainable by rolling there have been proposed methods such as that disclosed in Japanese Published Unexamined Patent Application No. 61(1986)-213,322, which relates to a method wherein oxide-system inclusions including a composite crystalline phase consisting of either or both of TiO and $Ti_2O_3$ are used as transformation nuclei. With this method, however, the quality of the steel is greatly affected by ther amount of Ti incorporated and, moreover, precise control of the amount of Ti in the refinement step becomes difficult.

As regards methods which use Ti-system inclusions as transformation nuclei for realizing a fine-grained texture, there are known techniques for attaining high toughness of welded metal or of the heat-affected zone (HAZ) in welding.

In the production of steel plate, for utilization of Ti oxide-system precipitates as transformation nuclei it is necessary for the Ti oxide precipitates to be fine and well dispersed. If excessive Ti is added, the residual Ti in solid solution will lead to precipitation harding and this in turn will impair toughness, particularly at welding heat affected zones and the like. Precise control of Ti content must therefore be carried out at the refining step. As this is not easy, it is difficult to realize stable and efficient production.

SUMMARY OF THE INVENTION

An object of the invention is to provide a method for stably and efficiently producing steel plate by the hot charge rolling process without the use of Ti-system inclusions.

Another object of the invention is to provide a method for stably and efficiently producing thick steel plate exhibiting superior low-temperature toughness by the hot charge rolling process without the use of Ti-system inclusions.

DETAILED DESCRIPTION OF THE INVENTION

The steel according to the present invention includes as its essential nonferrous constituents 0.001–0.300% (weight percent; the same hereinafter) of C, not more than 0.8% of Si, 0.4–2.0% of Mn, not more than 0.007% of Al and 0.0010–0.0100% of O. In addition, it may as required contain one or more of the following in the amounts indicated: not more than 1.5% of Cu, not more than 10% of Ni, not more than 1% of Cr, not more than 1% of Mo, not more than 0.2% of Nb, not more than 0.5% of V, not more than 0.05% of Ti, not more than 0.05% of Zr, not more than 0.0025% of B, not more than 0.05% of REM and not more than 0.008% Ca, the remainder being iron and unavoidable impurities.

C, Si and Mn enhance the strength of the steel and also promote structural harding at HAZ. They therefore have to be contained in appropriate quantities but care must be taken to prevent their content from becoming too high. From this viewpoint, a steel to be subjected to the method of this invention should contain C at from 0.001 to 0.300%, Si at not more than 0.8% and Mn at from 0.4 to 2.0%.

While Al is generally added for the purpose of deoxidization, if contained at more than 0.007%, it will interfere with the formation of oxide-system inclusions such as (Mn, Si)O that act as formation nuclei for a fine-grained acicular ferrite texture. Therefore the Al content is limited to not more than 0.007%. The O content is defined as falling in the range of 0.0010 to 0.0100% so as to ensure the presence an adequate amount of oxide inclusions without degrading the steel quality by the presence of excess O.

While Cu is effective for improving the corrosion resistance and strength of the steel, it promotes hot cracking at excessively high content levels. The content thereof has therefore been defined as not more than 1.5%.

As Ni enhances both the strength and low-temperature toughness of steel, it is added to steels which require these properties. However, when the amount of Ni exceeds 10%, the additional effect obtained is not commensurate with increased cost. For this reason, the content thereof has ben limited to not more than 10%.

Cr, Mo and B enhance the tempering characteristics of steel and in the process according to the present invention have an effect of stabilizing the acicular ferrite texture. However, when too much of these elements are present, hot cracking occurs at the time of transformation from the $\tau$ phase. Therefore, Cr and Mo are limited to not more than 1% each, while B is limited to not more than 0.0025%.

In the present invention, Nb and V contribute to increased steel strength by precipitating out as fine nitrides during cooling following rolling. However, too much of these elements deprives the steel of low-temperature toughness. Therefore, the content of Nb is limited to not more than 0.2% and that of V to not more than 0.5%.

As toughness deteriorates markedly when either the Ti or Zr content exceeds 0.05%, the upper limit for Ti and Zr content has been set at 0.05% each.

Ca and REM fix S contained in steel and thus work to reduce the MnS content, which is advantageous since MnS has a deleterious effect on the ductility and notch toughness of the steel. They are therefore added for this purpose. However, when present in excessive amounts they lower the cleanliness of the steel and become a cause for internal defects in the steel plate. Therefore, the upper limit of Ca content has been set at 0.008% and that of REM at 0.05%.

While the P, S and N content is of no special significance, the lower the content of these elements is the better is the toughness at weld joints (HAZ and the welded metal) of the steel. It is therefore preferable to maintain the content of P and S at not more than 0.025% and that of N at not more than 0.0050%.

Explanation will now be made regarding the rolling method and the cooling conditions following rolling in the method according to this invention.

In accordance with one aspect of the present invention, molten steel meeting the aforesaid requirements regarding chemical composition is cast in the thickness of the desired product plate, the cast steel is cooled between the liquidus and solidus at a cooling rate (hereinafter referred to as the "solidification rate") of not less than 10° C./min, and following solidification is cooled from 800° to 600° C. at a cooling rate of between 2° C./sec and not more than 50° C./sec.

In accordance with another aspect of the present invention, molten steel meeting the aforesaid requirements regarding chemical composition is cast in the thickness of the desired product plate, the cast steel is cooled between the liquidus and solidus at a solidification rate of not less than 10° C./min, the solidified steel is subjected to rolling in the course of cooling at a temperature of not less than 800° C. and at a reduction ratio of not more than 1.5, and the rolled steel is cooled from 800° to 600° C. at a cooling rate of between 2° C./sec and not more than 50° C./sec.

In the method according to the present invention, use is made of an acicular ferrite texture having oxide-system inclusions as the transformation nuclei. For this it is necessary to precipitate the (Mn, Si)O and other oxide-system inclusions serving at the transformation nuclei in the form of finely divided secondary deoxidization products.

The formation of secondary deoxidization products is closely related to the solidification rate. Specifically, the slower the solidification rate, the coarser are the secondary deoxidization product grains. Moreover, the number of the grains also decreases as the solidification rate becomes slower and at a rate lower than 10° C./min, it becomes difficult to obtain an adequate number. It is therefore necessary to use a solidification rate of not less than 10° C./min. Rolling at a temperature lower than 800° C. causes the rolled texture to remain in the $\tau$ phase, which is harmful to the formation of the acicular ferrite texture.

When the rolling is carried out at a reduction ratio of more than 1.5, the $\tau$ grains become fine and transformation from the grain boundary predominates, which is also harmful to the formation of the acicular ferrite texture. Therefore, rolling either is not carried out (i.e. the steel plate is left as cast) or is carried out at a temperature not lower than 800° C. and at a reduction ratio of not more than 1.5.

If the cooling rate below 800° C. is too fast, the texture becomes one of coarse bainite and martensite, and if it is too slow, ferritic pearlite is formed and, as a result, the acicular ferrite aimed at by the present invention cannot be obtained. Thus it is necessary to carry out cooling from 800° C. to below 600° C. at a rate of not less than 2° C./sec and not more than 50° C./sec.

The method of the present invention is capable of providing steels for use in various kinds of steel structures which are used at ambient or lower temperatures, and, specifically, can provide steels for use in line pipes, low-temperature pressurized storage vessels, ships and offshore structures.

In the conventional method of producing such steels, the casting has been followed by reheating and rolling, hot charge rolling or quenching/tempering, and then by normalizing, rolling and accelerated cooling.

In the method of the present method, the steel is subjected to accelerated cooling immediately after casting or after rolling at a small reduction ratio following casting, whereby a fine-grained acicular ferrite texture having oxide-system inclusions as the nuclei develops radially during the cooling step.

Thus in the production of thick plate, which is the main application of this invention, not only is the reheating step eliminated from the production processes but the rolling step is also eliminated or simplified. As a result, the casting step and the rolling step, if carried out at all, can be directly connected and/or integrated.

The present invention provides steel plate with strength and toughness equal to or better than that produced by conventional methods. Moreover, it enables production of high quality steel plate with no rolling whatsoever or at any rate with much less rolling than is used in the conventional methods. It therefore makes possible a dramatic improvement in productivity and reduction in facility cost.

EXAMPLES

Table 1 shows the chemical composition of samples taken from steel plates produced from slabs produced by vacuum melting.

Table 2 shows the production conditions of steel plates produced according to the invention and of steel plates produced according to the conventional method, and Table 3 shows the properties of plates produced from the same.

As will be noted, all of the steels produced by the method of the present invention exihibited better low-temperature toughness than the steels produced by the conventional method.

As steel A-3 having the composition A shown in Table 1 was rolled at a large reduction ratio of 2.0, the formation of $\tau$ grains advanced to some degree, with the result that the acicular ferrite texture could not be obtained and the toughness of the steel was poor. Steel A-4 was rolled at a temperature below 800° C. resulting in the development of rolled texture, with the result that formation of a fine acicular ferrite texture was hindered and the toughness was low.

Steel A-5 was subjected to a slow cooling rate in the transformation region, causing formation of a coarse ferritic pearlite texture and very poor toughness. In contrast, steel A-6 was subjected to too fast a cooling rate in the transformation region, which resulted in a coarse upper bainite texture and poor toughness. In the case of steel A-7, the solidification rate was less than 10° C./sec at one portion (at the final stage of solidification), whereby the formation of oxides that could serve as transformation nuclei became insufficient and as a result the steel exhibited low toughness.

The steels B-1 and B-2, both of which had the composition B shown in Table 1, had high Al contents of 0.025% so that $Al_2O_3$ became the main oxide formed, with the result that the amount of (Mn, Si)O-system oxides produced was inadequate and toughness was thus low.

TABLE 1

| Steel | C | Si | Mn | P | S | Al | O | N | Nb | Ti | Ca | Zr | B | Cu | Ni | Cr | Mo | V | (wt %) Rem |
|---|---|---|---|---|---|---|---|---|---|---|---|---|---|---|---|---|---|---|---|
| 0-1 | 0.03 | 0.50 | 1.85 | 0.001 | 0.001 | 0.007 | 0.0010 | 0.0050 | | | | | | | | | | | |
| 0-2 | 0.28 | 0.10 | 0.40 | 0.005 | 0.023 | 0.001 | 0.0030 | 0.0010 | | | | | | | | | | | |
| 0-3 | 0.15 | 0.25 | 1.05 | 0.024 | 0.010 | 0.004 | 0.0080 | 0.0025 | | | | | | | | | | | |
| 1-1 | 0.06 | 0.08 | 1.55 | 0.005 | 0.002 | 0.003 | 0.0045 | 0.0030 | 0.020 | | | | | | | | | | |
| 1-2 | 0.07 | 0.10 | 1.50 | 0.010 | 0.005 | 0.005 | 0.0020 | 0.0018 | | 0.015 | | | | | | | | | |
| 1-3 | 0.06 | 0.15 | 1.53 | 0.015 | 0.015 | 0.003 | 0.0033 | 0.0015 | | | | 0.014 | | | | | | | |
| 1-4 | 0.08 | 0.12 | 1.48 | 0.011 | 0.003 | 0.004 | 0.0035 | 0.0020 | | | | | 0.0010 | | | | | | |
| 1-5 | 0.08 | 0.05 | 1.20 | 0.010 | 0.020 | 0.002 | 0.0070 | 0.0043 | | | | | | 1.5 | | | | | |
| 1-6 | 0.20 | 0.20 | 1.35 | 0.025 | 0.015 | 0.003 | 0.0095 | 0.0021 | | | | | | | 1.0 | | | | |
| 1-7 | 0.25 | 0.10 | 0.43 | 0.018 | 0.025 | 0.006 | 0.0050 | 0.0038 | | | | | | | | 0.8 | | | |
| 1-8 | 0.15 | 0.75 | 1.45 | 0.023 | 0.011 | 0.002 | 0.0063 | 0.0045 | | | | | | | | | 0.6 | | |
| 1-9 | 0.08 | 0.25 | 1.41 | 0.002 | 0.021 | 0.002 | 0.0013 | 0.0017 | | | | | | | | | | 0.10 | |
| 1-10 | 0.10 | 0.19 | 1.45 | 0.003 | 0.001 | 0.001 | 0.0023 | 0.0019 | | | | | | | | | | | 0.02 |
| 2-1 | 0.01 | 0.80 | 1.96 | 0.005 | 0.002 | 0.001 | 0.0025 | 0.0035 | 0.050 | 0.007 | | | | | | | | | |
| 2-2 | 0.11 | 0.30 | 0.85 | 0.006 | 0.008 | 0.007 | 0.0088 | 0.0049 | 0.005 | | 0.0040 | | | | | | | | |
| 2-3 | 0.05 | 0.01 | 0.70 | 0.008 | 0.005 | 0.003 | 0.0015 | 0.0023 | 0.013 | | | 0.007 | | | | | | | |
| 2-4 | 0.13 | 0.43 | 1.13 | 0.018 | 0.007 | 0.003 | 0.0038 | 0.0011 | 0.025 | | | | 0.0023 | | | | | | |
| 2-5 | 0.18 | 0.22 | 0.64 | 0.010 | 0.005 | 0.003 | 0.0033 | 0.0028 | 0.038 | | | | | 1.0 | | | | | |
| 2-6 | 0.08 | 0.20 | 1.41 | 0.009 | 0.004 | 0.002 | 0.0018 | 0.0035 | 0.008 | | | | | | 0.5 | | | | |
| 2-7 | 0.08 | 0.23 | 1.45 | 0.010 | 0.006 | 0.003 | 0.0022 | 0.0021 | 0.015 | | | | | | | 0.5 | | | |
| 2-8 | 0.08 | 0.18 | 1.38 | 0.011 | 0.005 | 0.004 | 0.0025 | 0.0023 | 0.008 | | | | | | | | | 0.07 | |
| 2-9 | 0.07 | 0.25 | 1.51 | 0.008 | 0.009 | 0.003 | 0.0023 | 0.0027 | | 0.020 | 0.0028 | | | | | | | | |
| 2-10 | 0.09 | 0.21 | 1.35 | 0.010 | 0.007 | 0.001 | 0.0046 | 0.0030 | | 0.013 | | 0.010 | | | | | | | |
| 2-11 | 0.08 | 0.20 | 1.40 | 0.009 | 0.008 | 0.002 | 0.0037 | 0.0024 | | 0.004 | | 0.0015 | | | | | | | |
| 2-12 | 0.15 | 0.15 | 0.60 | 0.015 | 0.010 | 0.005 | 0.0035 | 0.0033 | | 0.009 | | | | 0.4 | | | | | |
| 2-13 | 0.13 | 0.04 | 0.65 | 0.011 | 0.013 | 0.003 | 0.0015 | 0.0018 | | 0.006 | | | | | 0.1 | | | | |
| 2-14 | 0.12 | 0.08 | 0.73 | 0.008 | 0.003 | 0.004 | 0.0016 | 0.0047 | | 0.011 | | | | | | 0.1 | | | |
| 2-15 | 0.11 | 0.35 | 0.80 | 0.010 | 0.005 | 0.006 | 0.0033 | 0.0020 | | 0.002 | | | | | | | | 0.02 | |
| 2-16 | 0.08 | 0.21 | 1.43 | 0.009 | 0.006 | 0.003 | 0.0035 | 0.0033 | | | 0.0010 | 0.002 | | | | | | | |
| 2-17 | 0.09 | 0.56 | 1.33 | 0.011 | 0.005 | 0.002 | 0.0031 | 0.0045 | | | 0.0005 | | 0.0009 | | | | | | |
| 2-18 | 0.08 | 0.25 | 1.56 | 0.010 | 0.004 | 0.003 | 0.0030 | 0.0038 | | | | 0.006 | 0.0001 | | | | | | |
| 2-19 | 0.08 | 0.20 | 1.50 | 0.008 | 0.003 | 0.001 | 0.0033 | 0.0046 | | | | | | 0.6 | 0.2 | | | | |
| 2-20 | 0.15 | 0.25 | 1.00 | 0.025 | 0.018 | 0.003 | 0.0022 | 0.0023 | | | | | | 0.2 | | | | 0.03 | |
| 3-1 | 0.05 | 0.25 | 1.10 | 0.025 | 0.005 | 0.003 | 0.0023 | 0.0037 | | 0.009 | | | | 0.2 | 0.1 | | | | |
| 3-2 | 0.07 | 0.24 | 0.91 | 0.015 | 0.001 | 0.002 | 0.0063 | 0.0025 | | | | | 0.0007 | 0.1 | 0.2 | | | | |
| 3-3 | 0.08 | 0.23 | 1.30 | 0.014 | 0.002 | 0.003 | 0.0045 | 0.0033 | 0.015 | 0.012 | 0.0020 | | | | | | | | |
| 3-4 | 0.10 | 0.21 | 1.31 | 0.023 | 0.005 | 0.002 | 0.0025 | 0.0028 | 0.016 | 0.008 | | | | | | | | 0.06 | |
| 3-5 | 0.05 | 0.35 | 1.41 | 0.011 | 0.003 | 0.003 | 0.0028 | 0.0032 | 0.038 | 0.018 | | | 0.0013 | | | | | | |
| 3-6 | 0.08 | 0.18 | 1.45 | 0.018 | 0.004 | 0.004 | 0.0030 | 0.0021 | | 0.001 | 0.0011 | 0.003 | | | | | | | |
| 3-7 | 0.09 | 0.25 | 1.40 | 0.010 | 0.005 | 0.003 | 0.0031 | 0.0044 | 0.010 | | | | 0.0009 | | | | | 0.01 | |
| 3-8 | 0.13 | 0.20 | 1.05 | 0.008 | 0.003 | 0.003 | 0.0028 | 0.0024 | 0.013 | | | | | | 0.3 | | 0.1 | | |
| 3-9 | 0.16 | 0.17 | 1.10 | 0.010 | 0.002 | 0.003 | 0.0034 | 0.0049 | 0.007 | | | | | 0.2 | 0.2 | | | | |
| 4-1 | 0.07 | 0.28 | 0.85 | 0.013 | 0.001 | 0.003 | 0.0021 | 0.0045 | 0.018 | 0.015 | 0.0003 | | 0.0003 | | | | | | |
| 4-2 | 0.12 | 0.21 | 1.31 | 0.018 | 0.005 | 0.004 | 0.0033 | 0.0037 | 0.034 | 0.024 | | | 0.0005 | | | | | 0.03 | |
| 4-3 | 0.08 | 0.10 | 1.40 | 0.005 | 0.001 | 0.002 | 0.0020 | 0.0014 | 0.005 | 0.005 | | | | 0.1 | 0.2 | | | | |
| 4-4 | 0.08 | 0.15 | 1.30 | 0.008 | 0.002 | 0.003 | 0.0045 | 0.0011 | 0.015 | | | | 0.0003 | | 0.1 | | | 0.02 | |
| 5-1 | 0.10 | 0.20 | 1.21 | 0.010 | 0.008 | 0.003 | 0.0020 | 0.0035 | 0.021 | 0.011 | | | | 0.2 | 0.1 | 0.4 | | | |
| 5-2 | 0.07 | 0.21 | 1.08 | 0.009 | 0.001 | 0.002 | 0.0025 | 0.0023 | 0.023 | 0.014 | 0.0015 | | | 0.2 | 0.2 | | | | |
| 5-3 | 0.08 | 0.29 | 1.45 | 0.022 | 0.004 | 0.001 | 0.0041 | 0.0025 | 0.056 | 0.010 | | | | 0.2 | 0.1 | | | 0.08 | |
| 5-4 | 0.02 | 0.18 | 1.25 | 0.025 | 0.005 | 0.003 | 0.0028 | 0.0036 | 0.040 | 0.011 | | | 0.0011 | 0.1 | 0.1 | | | | |
| 5-5 | 0.12 | 0.25 | 0.85 | 0.010 | 0.020 | 0.003 | 0.0035 | 0.0045 | | | | | | 0.2 | 0.5 | 0.4 | 0.3 | 0.03 | |

TABLE 2

| Composition | Slab thickness (mm) | Reduction ratio | Plate thickness (mm) | Rolling conditions: Rolling start temp. (°C.) | Rolling conditions: Rolling completion temp. (°C.) | Transformation cooling conditions: Cooling start temp. (°C.) | Transformation cooling conditions: Cooling termination temp. (°C.) | Transformation cooling conditions: Cooling rate from 800° C. to below 600 ° C. (°C./sec) | Mean solidification cooling rate at the final stage of solidification (°C./min) | Remarks |
|---|---|---|---|---|---|---|---|---|---|---|
| 0-1 | 50 | 1.0 | 50 | No rolling | No rolling | 900 | 351 | 25 | 41 | |

TABLE 2-continued

| Composition | Slab thickness (mm) | Reduction ratio | Plate thickness (mm) | Rolling conditions: Rolling start temp. (°C.) | Rolling conditions: Rolling completion temp. (°C.) | Transformation cooling conditions: Cooling start temp. (°C.) | Transformation cooling conditions: Cooling termination temp. (°C.) | Transformation cooling conditions: Cooling rate from 800° C. to below 600 ° C. (°C./sec) | Mean solidification cooling rate at the final stage of solidification (°C./min) | Remarks |
|---|---|---|---|---|---|---|---|---|---|---|
| 0-2 | 9 | 1.5 | 6 | 1000 | 945 | 900 | 534 | 50 | 430 | |
| 0-3 | 150 | 1.25 | 120 | 900 | 864 | 800 | 151 | 2 | 10 | |
| 1-1 | 30 | 1.2 | 25 | 950 | 937 | 900 | 451 | 7 | 81 | |
| 1-2 | 25 | 1.0 | 25 | No rolling | No rolling | 900 | 345 | 11 | 110 | |
| 1-3 | 100 | 1.11 | 90 | 900 | 885 | 850 | 498 | 5 | 15 | |
| 1-4 | 15 | 1.5 | 10 | 950 | 918 | 850 | 318 | 24 | 211 | |
| 1-5 | 20 | 1.0 | 20 | No rolling | No rolling | 800 | 85 | 45 | 150 | |
| 1-6 | 70 | 1.4 | 50 | 900 | 868 | 850 | 545 | 20 | 25 | |
| 1-7 | 30 | 1.2 | 25 | 950 | 937 | 900 | 463 | 8 | 90 | |
| 1-8 | 40 | 1.21 | 33 | 1000 | 963 | 900 | 256 | 35 | 60 | |
| 1-9 | 30 | 1.5 | 20 | 1100 | 1043 | 1000 | 450 | 15 | 84 | |
| 1-10 | 10 | 1.1 | 10 | No rolling | No rolling | 900 | 331 | 18 | 380 | |
| 2-1 | 60 | 1.0 | 60 | No rolling | No rolling | 850 | 580 | 13 | 33 | |
| 2-2 | 50 | 1.25 | 40 | 900 | 873 | 800 | 471 | 9 | 14 | Uni-directional solidification |
| 2-3 | 6 | 1.33 | 4.5 | 900 | 840 | 800 | 333 | 10 | 740 | |
| 2-4 | 12 | 1.0 | 12 | No rolling | No rolling | 1000 | 516 | 21 | 290 | |
| 2-5 | 120 | 1.2 | 100 | 1200 | 1133 | 1100 | 436 | 3 | 13 | |
| 2-6 | 20 | 1.11 | 18 | 900 | 888 | 850 | 363 | 10 | 60 | Uni-directional solidification |
| 2-7 | 15 | 1.0 | 15 | No rolling | No rolling | 950 | 441 | 42 | 218 | |
| 2-8 | 25 | 1.0 | 25 | No rolling | No rolling | 1200 | 363 | 13 | 123 | |
| 2-9 | 50 | 1.43 | 35 | 900 | 863 | 800 | 453 | 15 | 43 | |
| 2-10 | 50 | 1.11 | 45 | 850 | 835 | 800 | 218 | 8 | 46 | |
| 2-11 | 10 | 1.25 | 8 | 1000 | 963 | 900 | 411 | 38 | 363 | |
| 2-12 | 40 | 1.0 | 40 | No rolling | No rolling | 900 | 488 | 10 | 21 | Uni-directional solidification |
| 2-13 | 20 | 1.33 | 15 | 900 | 850 | 800 | 593 | 9 | 145 | |
| 2-14 | 20 | 1.0 | 20 | No rolling | No rolling | 900 | 332 | 11 | 138 | |
| 2-15 | 4.5 | 1.0 | 4.5 | No rolling | No rolling | 900 | 551 | 8 | 1050 | |
| 2-16 | 25 | 1.25 | 20 | 1250 | 1211 | 1200 | 443 | 15 | 105 | |
| 2-17 | 50 | 1.25 | 40 | 1400 | 1332 | 1300 | 414 | 6 | 41 | |
| 2-18 | 50 | 1.43 | 35 | 900 | 811 | 800 | 557 | 18 | 48 | |
| 2-19 | 7 | 1.4 | 5 | 1000 | 978 | 800 | 374 | 20 | 615 | |
| 2-20 | 90 | 1.5 | 60 | 1100 | 983 | 850 | 515 | 12 | 18 | |
| 3-1 | 30 | 1.5 | 20 | 1000 | 943 | 900 | 298 | 5 | 91 | |
| 3-2 | 24 | 1.2 | 20 | 1000 | 968 | 800 | 347 | 8 | 97 | |
| 3-3 | 100 | 1.0 | 100 | No rolling | No rolling | 1250 | 418 | 4 | 16 | |
| 3-4 | 40 | 1.33 | 30 | 900 | 851 | 800 | 568 | 10 | 52 | |
| 3-5 | 40 | 1.48 | 27 | 900 | 840 | 800 | 403 | 15 | 56 | |
| 3-6 | 40 | 1.11 | 36 | 900 | 888 | 800 | 501 | 12 | 63 | |
| 3-7 | 30 | 1.3 | 23 | 1000 | 987 | 950 | 358 | 9 | 77 | |
| 3-8 | 90 | 1.28 | 70 | 1400 | 1341 | 1200 | 498 | 6 | 20 | |
| 3-9 | 80 | 1.0 | 80 | No rolling | No rolling | 900 | 313 | 5 | 23 | |
| 4-1 | 20 | 1.43 | 14 | 1000 | 943 | 900 | 508 | 25 | 158 | |
| 4-2 | 20 | 1.0 | 20 | No rolling | No rolling | 1300 | 425 | 18 | 129 | |
| 4-3 | 50 | 1.25 | 40 | 1200 | 1176 | 1150 | 318 | 16 | 38 | |
| 4-4 | 35 | 1.0 | 35 | No rolling | No rolling | 900 | 551 | 11 | 64 | |
| 5-1 | 70 | 1.4 | 50 | 1200 | 1154 | 1100 | 593 | 10 | 27 | |
| 5-2 | 8 | 1.0 | 8 | No rolling | No rolling | 1000 | 491 | 28 | 504 | |
| 5-3 | 12 | 1.5 | 8 | 1400 | 1348 | 1300 | 403 | 7 | 260 | |
| 5-4 | 18 | 1.0 | 18 | No rolling | No rolling | 900 | 450 | 11 | 170 | |
| 5-5 | 35 | 1.0 | 35 | No rolling | No rolling | 1000 | 383 | 10 | 66 | |

TABLE 3

| Composition | Tensile strength test JIS5 Y S (kg/mm²) | Tensile strength test JIS5 T S (kg/mm²) | Charpy test JIS4 Absorbed energy (Mean value) vE-20° C. (kg · m) | Charpy test JIS4 vTrs (°C.) | Microscopic texture |
|---|---|---|---|---|---|
| 0-1 | 46.3 | 56.0 | 25.3 | −60 | Acicular ferrite |
| 0-2 | 49.0 | 60.5 | 13.4 | −29 | Acicular ferrite |
| 0-3 | 31.8 | 44.2 | 17.1 | −38 | Acicular ferrite |
| 1-1 | 44.8 | 55.1 | 21.8 | −53 | Acicular ferrite |
| 1-2 | 42.5 | 53.7 | 19.7 | −48 | Acicular ferrite |
| 1-3 | 35.0 | 47.8 | 14.1 | −33 | Acicular ferrite |
| 1-4 | 48.0 | 57.2 | 22.7 | −58 | Acicular ferrite |
| 1-5 | 47.5 | 59.3 | 18.1 | −40 | Acicular ferrite |
| 1-6 | 53.1 | 65.3 | 13.1 | −30 | Acicular ferrite |
| 1-7 | 48.0 | 60.3 | 12.3 | −28 | Acicular ferrite |
| 1-8 | 51.5 | 62.8 | 14.0 | −32 | Acicular ferrite |
| 1-9 | 42.2 | 53.0 | 20.5 | −48 | Acicular ferrite |
| 1-10 | 41.5 | 52.5 | 17.5 | −41 | Acicular ferrite |
| 2-1 | 31.5 | 43.3 | 18.8 | −53 | Acicular ferrite |
| 2-2 | 36.0 | 47.4 | 18.0 | −45 | Acicular ferrite |
| 2-3 | 29.3 | 40.5 | 19.6 | −55 | Acicular ferrite |
| 2-4 | 48.3 | 59.8 | 17.9 | −47 | Acicular ferrite |
| 2-5 | 36.1 | 48.2 | 15.0 | −33 | Acicular ferrite |
| 2-6 | 44.3 | 55.3 | 24.7 | −65 | Acicular ferrite |
| 2-7 | 46.5 | 57.6 | 19.9 | −48 | Acicular ferrite |
| 2-8 | 43.6 | 54.5 | 20.8 | −51 | Acicular ferrite |
| 2-9 | 44.7 | 55.0 | 19.8 | −50 | Acicular ferrite |
| 2-10 | 43.0 | 54.1 | 17.7 | −43 | Acicular ferrite |
| 2-11 | 47.9 | 58.4 | 16.0 | −35 | Acicular ferrite |
| 2-12 | 38.3 | 48.7 | 15.5 | −36 | Acicular ferrite |
| 2-13 | 36.5 | 46.6 | 17.0 | −40 | Acicular ferrite |
| 2-14 | 35.9 | 45.8 | 18.3 | −42 | Acicular ferrite |
| 2-15 | 33.9 | 45.3 | 15.0 | −35 | Acicular ferrite |
| 2-16 | 42.4 | 53.0 | 16.3 | −41 | Acicular ferrite |
| 2-17 | 41.8 | 52.5 | 18.9 | −55 | Acicular ferrite |
| 2-18 | 44.3 | 55.0 | 19.3 | −49 | Acicular ferrite |
| 2-19 | 43.9 | 55.3 | 19.1 | −53 | Acicular ferrite |
| 2-20 | 43.4 | 54.2 | 18.7 | −45 | Acicular ferrite |
| 3-1 | 29.5 | 42.1 | 19.5 | −48 | Acicular ferrite |
| 3-2 | 31.2 | 43.1 | 24.3 | −56 | Acicular ferrite |
| 3-3 | 43.1 | 54.3 | 22.5 | −55 | Acicular ferrite |
| 3-4 | 43.8 | 55.0 | 18.5 | −40 | Acicular ferrite |

TABLE 3-continued

| Composition | Tensile strength test JIS5 Y S (kg/mm²) | Tensile strength test JIS5 T S (kg/mm²) | Charpy test JIS4 Absorbed energy (Mean value) vE-20° C. (kg · m) | Charpy test JIS4 vTrs (°C.) | Microscopic texture |
|---|---|---|---|---|---|
| 3-5 | 47.5 | 57.6 | 19.1 | −48 | Acicular ferrite |
| 3-6 | 42.9 | 53.4 | 17.5 | −46 | Acicular ferrite |
| 3-7 | 45.3 | 56.2 | 20.3 | −51 | Acicular ferrite |
| 3-8 | 42.8 | 54.1 | 17.9 | −41 | Acicular ferrite |
| 3-9 | 44.3 | 55.5 | 15.8 | −38 | Acicular ferrite |
| 4-1 | 33.0 | 45.6 | 22.2 | −55 | Acicular ferrite |
| 4-2 | 46.9 | 58.3 | 15.0 | −35 | Acicular ferrite |
| 4-3 | 42.9 | 54.0 | 25.1 | −59 | Acicular ferrite |
| 4-4 | 43.3 | 54.5 | 20.9 | −50 | Acicular ferrite |
| 5-1 | 40.1 | 51.3 | 18.0 | −40 | Acicular ferrite |
| 5-2 | 35.1 | 46.8 | 19.3 | −45 | Acicular ferrite |
| 5-3 | 46.2 | 57.0 | 18.8 | −43 | Acicular ferrite |
| 5-5 | 46.7 | 55.3 | 17.8 | −41 | Acicular ferrite |

We claim:

1. A method for producing a steel plate with excellent toughness at low temperature comprising the steps of:

providing a steel melt containing, as fundamental ingredients, 0.001–0.300 weight % C, less than 0.8 weight % Si, 0.4–2.0 weight % Mn, less than 0.007 weight % Al, 0.0010–0.0100 weight % 0, the remainder Fe and unavoidable impurities, producing a continuous cast slab from said steel melt, cooling said slab between the liquidus and solidus thereof at a cooling rate of not less than 10° C./min. in order to make an inclusion of (MnSi)O disperse and precipitate throughout said slab, with or without rolling said solidified slab starting from a temperature of not less than 800° C., with the reduction ratio of less than 1.5, and cooling said rolled or said as-cast slab from 800° C. to less than 600° C., at a cooling rate of from 2° C./sec. to 50° C./sec., whereby said steel is provided with an acicular-ferrite texture.

2. The method as claimed in claim 1, wherein, in addition to the essential nonferrous components, the iron and the unavoidable impurities, the steel melt further includes one or two members selected from among not more than 1.5 wt % Cu, not more than 10 wt % Ni, not more than 1 wt % Cr, not more than 1 wt % Mo, not more than 0.2 wt % Nb, not more than 0.5 wt % V, not more than 0.05 wt % Ti, not more than 0.0025 wt % B, not more than 0.05 wt % REM, not more than 0.008 wt % Ca and not more than 0.05% Zr.

3. The method as claimed in claim 1 wherein, in addition to the essential nonferrous components, the iron and the unavoidable impurities, the steel melt further includes three members selected from among not more than 1.5 wt % Cu, not more than 10 wt % Ni, not more than 1 wt % Cr, not more than 1 wt % Mo, not more than 0.2 wt % Nb, not more than 0.5 wt % V, not more than 0.05 wt % Ti, not more than 0.0025 wt % B, not more than 0.05 wt % REM, not more than 0.008 wt % Ca and not more than 0.05% Zr, the three members being selected in one of the following combinations:

(i) Ti, Cu, Ni
(ii) B, Cu, Ni
(iii) Nb, Ti, Ca
(iv) Nb, Ti, V
(v) Nb, Ti, B
(vi) Ti, Ca, Zr
(vii) Nb, B, V
(viii) Nb, Ni, Mo
(ix) Nb, Cu, Ni

4. The method as claimed in claim 1 wherein, in addition to the essential nonferrous components, the iron and the unavoidable impurities, the steel melt further includes four members selected from among not more than 1.5 wt % Cu, not more than 10 wt % Ni, not more than 1 wt % Cr, not more than 1 wt % Mo, not more than 0.2 wt % Nb, not more than 0.5 wt % V, not more than 0.05 wt % Ti, not more than 0.0025 wt % B, not more than 0.05 wt % REM, not more than 0.008 wt % Ca and not more than 0.05% Zr, the four members being selected in one of the following combinations:

(i) Nb, Ti, Ca, B
(ii) Nb, Ti,B, V
(iii) Nb, Ti, Cu, Ni
(iv) Nb, B, Ni, V

5. The method as claimed in claim 1 wherein, in addition to the essential nonferrous components, the iron and the unavoidable impurities, the steel melt further includes five members selected from among not more than 1.5 wt % Cu, not more than 10 wt % Ni, not more than 1 wt % Cr, not more than 1 wt % Mo, not more than 0.2 wt % Nb, not more than 0.5 wt % V, not more than 0.05 wt % Ti, not more than 0.0025 wt % B, not more than 0.05 wt % REM, not more than 0.008 wt % Ca and not more than 0.05% Zr, the five members being selected in one of the following combinations:

(i) Nb, Ti, Cu, Ni, Cr
(ii) Nb, Ti, Ca, Cu, Ni
(iii) Nb, Ti, Cu, Ni, V
(iv) Nb, Ti, B, Cu, Ni
(v) Cu, Ni, Cr, Mo, V.

* * * * *